US005738026A

United States Patent [19]

Ciucani

[11] Patent Number: 5,738,026

[45] Date of Patent: Apr. 14, 1998

[54] DEVICE FOR SEWING TWO ARTICLES, IN PARTICULAR LEATHER ARTICLES WITH OVERLAPPED EDGES

[76] Inventor: Mario Ciucani, Via S. Girolamo, Fermo (Ascoli Piceno), Italy

[21] Appl. No.: 849,019

[22] PCT Filed: Dec. 20, 1995

[86] PCT No.: PCT/IB95/01145

§ 371 Date: May 27, 1997

§ 102(e) Date: May 27, 1997

[87] PCT Pub. No.: WO96/20306

PCT Pub. Date: Jul. 4, 1996

[30] Foreign Application Priority Data

Dec. 23, 1994 [IT] Italy ..... MC940031 U

[51] Int. Cl.[6] ..... D05B 15/02; D05B 27/20; D05B 35/10

[52] U.S. Cl. ..... 112/49; 112/62; 112/153; 112/310; 112/321

[58] Field of Search ..... 112/49, 50, 51, 112/60, 62, 61, 28, 47, 63, 136, 310, 321, 153, 235; 12/146 C, 123, 13.2

[56] References Cited

U.S. PATENT DOCUMENTS 2,399,159 4/1946 Ashworth ..... 112/62

3,776,158 12/1973 Zechini .

4,848,252 7/1989 Ciucani .

5,207,169 5/1993 Ciucani ..... 112/49

FOREIGN PATENT DOCUMENTS 0 035 003 9/1991 European Pat. Off. .

*Primary Examiner*—Peter Nerbun

*Attorney, Agent, or Firm*—McAulay Fisher Nissen Goldberg & Kiel, LLP

[57] ABSTRACT

An improved device for sewing two articles with overlapped edges, includes a longitudinal guide (7), laterally delimited by two inclined, upwardly convergent, flat surfaces (*7a*,*7b*) on which a first article (1) and second article (2) to be sewn are moved. A curved winglet (11) is made integral with the top of the guide (7) and is bent downwards to overhang one of the inclined surface (*7b*). A folding over member (12), moves vertically over the longitudinal guide (7), so as to clamp an edge (3) of the first article (1) on the curved winglet (11), thus folding over the edge (3) so as to overlap a corresponding edge of the second article (2), while a needle (20) makes a stitch (4). A support element (17), equipped with a presser foot (18), presses the edge of the second article against the inclined surface (*7b*) of the guide (7).

7 Claims, 5 Drawing Sheets

FIG. 1
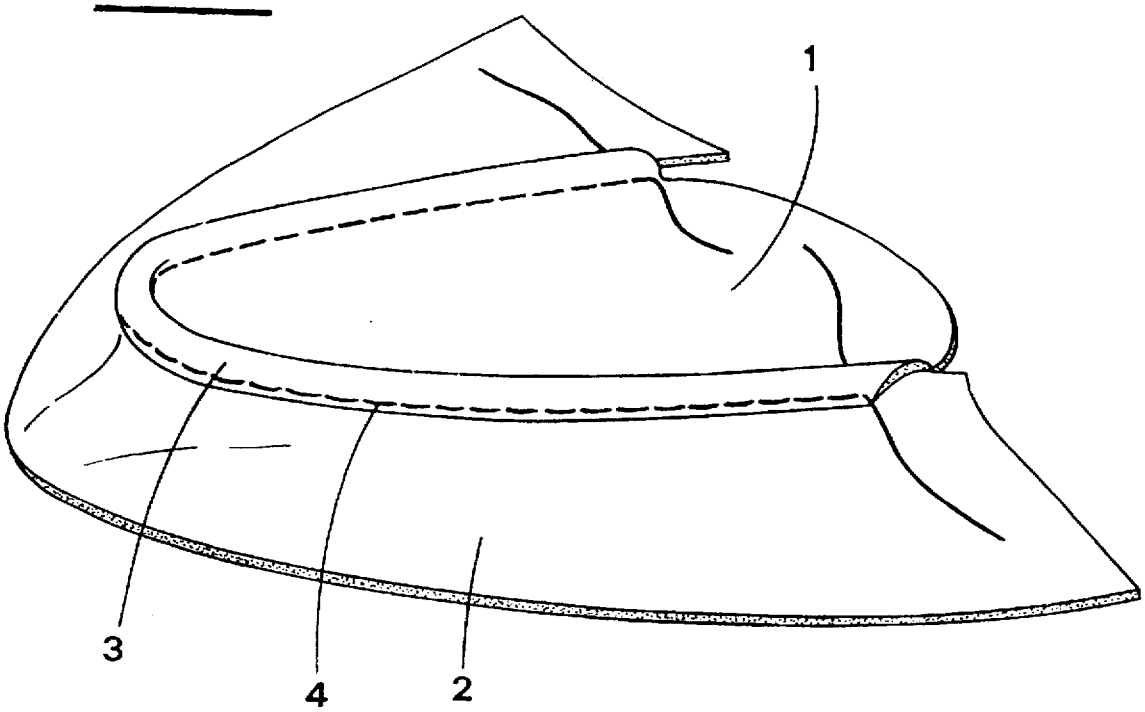
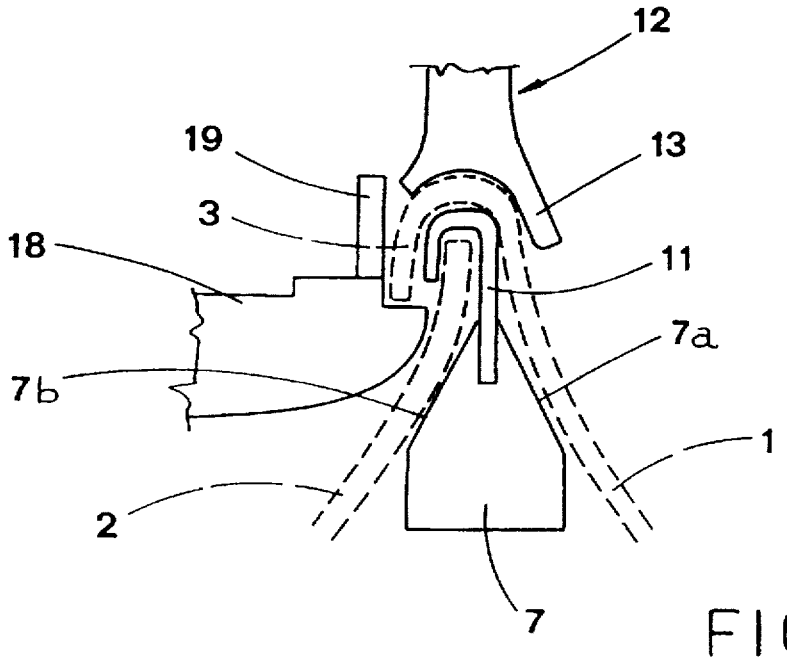
FIG. 9

DEVICE FOR SEWING TWO ARTICLES, IN PARTICULAR LEATHER ARTICLES WITH OVERLAPPED EDGES

TECHNICAL FIELD

The present invention relates to sewing leather articles or the like, in particular for footwear production.

BACKGROUND ART

Known automatic machines for sewing leather articles like e.g. a toe cap and an upper of a shoe, usually feature a head, cantilevered on the front of a base structure and equipped with means supporting the needle and relative operating means.

The needle is moved toward an arm, situated below, that acts as a horizontal support, on which the leather articles to be sewn rest.

The needle moves also in direction parallel to the support arm. The above mentioned machines are equipped also with feeding means that move forward the edges of the leather articles to be sewn after each stitch.

A machine of this type is disclosed in the U.S. Pat. No. 4,848,252 of the same Applicant. This machine includes a guide that longitudinally defines two flat inclined surfaces, upwardly convergent, that form respective work tops, on which the leather articles to be sewn are moved.

Over the guide, there is a longitudinal shaft, with an arm keyed thereto and provided at its free extremity with a curved needle.

The shaft is oscillated so as to alternatively move the needle between a raised position and a lowered position, in order to piece the edges of the leather articles.

The needle operates in combination with a crochet with a thread. The above mentioned machine is designed to sew edges of shoe uppers and toe caps of any shape.

However, this machine cannot be used for decorative stitches, such as, in particular for sewing overlapped edges, i.e. with the edge of the toe cap folded over and overlapping the edge of the shoe upper.

To solve this problem, a device for sewing two leather articles with overlapped edges, is disclosed in the Italian Patent Application No. BO94A 000048, owned by the same Applicant.

This machine includes a longitudinal guide formed by a lower fixed part that features, at its top, a curved winglet folded downwards, and an upper movable part mounted slidably along the same lower fixed part.

The fixed and movable parts of the guide define two inclined flat surfaces, upwardly convergent, on which articles to be sewn are moved.

A folding member moves vertically over the longitudinal guide and is aimed at clamping the edge of the first article to the curved winglet, so that the edge overlaps the edge of the second article, while the stitch is made.

The movable part of the guide is reciprocated by an operation group, that furthermore features a foot designed to press the edge of the second article against the surface of the same movable part. Moreover, the above mentioned device can also make a curling along the edge to be sewn, in particular along the shoe upper edge.

This curling is necessary specially for compensating for a different outline length of a shoe upper with respect to toe cap, when the shoe upper has a bottom and its outer edge is folded upwards to be joined to the toe cap.

The curling is not necessary when the shoe upper is of open type, i.e. when the upper does not have the bottom, but only a lateral band.

In fact, in this case, the shoe upper is made by a strip of leather with an edge joined to the upper and this edge of the strip of leather has basically the same length as the outline length of the upper.

FIG. 1 shows, as an example, a semi-manufactured product, from which a shoe is obtained. In its upper part, this semi-manufactured product features a toe cap 1 sewn along its edge to a shoe upper 2 of open type; the folded over edge 3 of the toe cap 1 overlaps the corresponding edge of the shoe upper 2 and is sewn thereto by stitches 4.

DISCLOSURE OF THE INVENTION

The object of the present invention is to provide a device for sewing two leather articles, specially the toe cap and an open upper, with overlapped edges.

The above mentioned object is obtained, in accordance with the invention, by means of a device for sewing two articles, particularly leather articles, with overlapped edges, improved so that it includes a longitudinal guide, a part of which is laterally delimited by two inclined flat surfaces upwardly convergent, on which a first article and a second article to be sewn together are moved, with a curved winglet, made integral with the top of the longitudinal guide and bent downwards to overhang the inclined surface of the same guide.

A folding over member is moved vertically over the longitudinal guide so as to clamp and release an edge of the first article on the curved winglet, thus folding the same edge so as to overlap an edge of the second article, while a needle makes a stitch.

A support element, equipped with a foot, is provided for pressing the edge of the second article against the inclined surface of the guide.

BRIEF DESCRIPTION OF THE DRAWINGS

The characteristic features of the present invention are pointed out in the following description with reference to the enclosed drawings, in which:

FIG. 1 is a perspective view of a semi-manufactured product, from which a shoe is obtained, with the shoe upper sewn to the toe cap with overlapped edges;

FIG. 9 is a transversal section view of a particular of the device.

BEST MODE OF CARRYING OUT THE INVENTION

Figure 3:
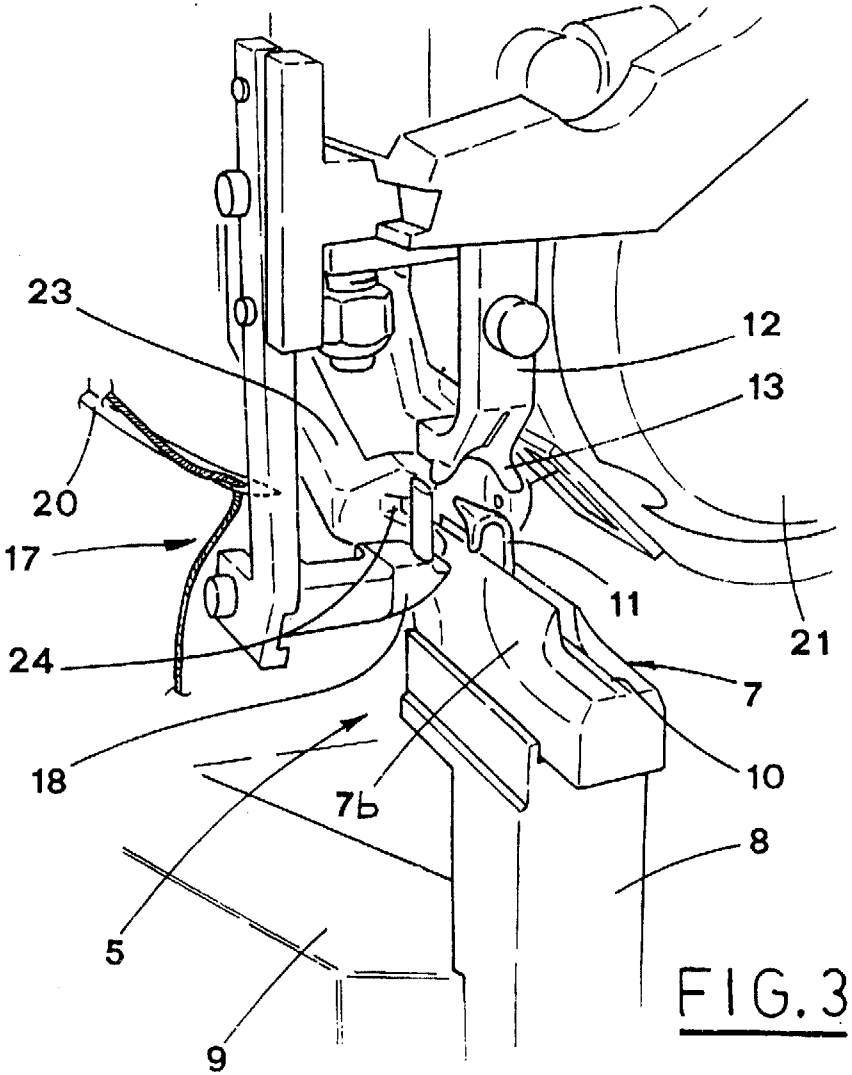
FIG. 3 is a perspective view of a detail of the said stitching device.
Figure 2:
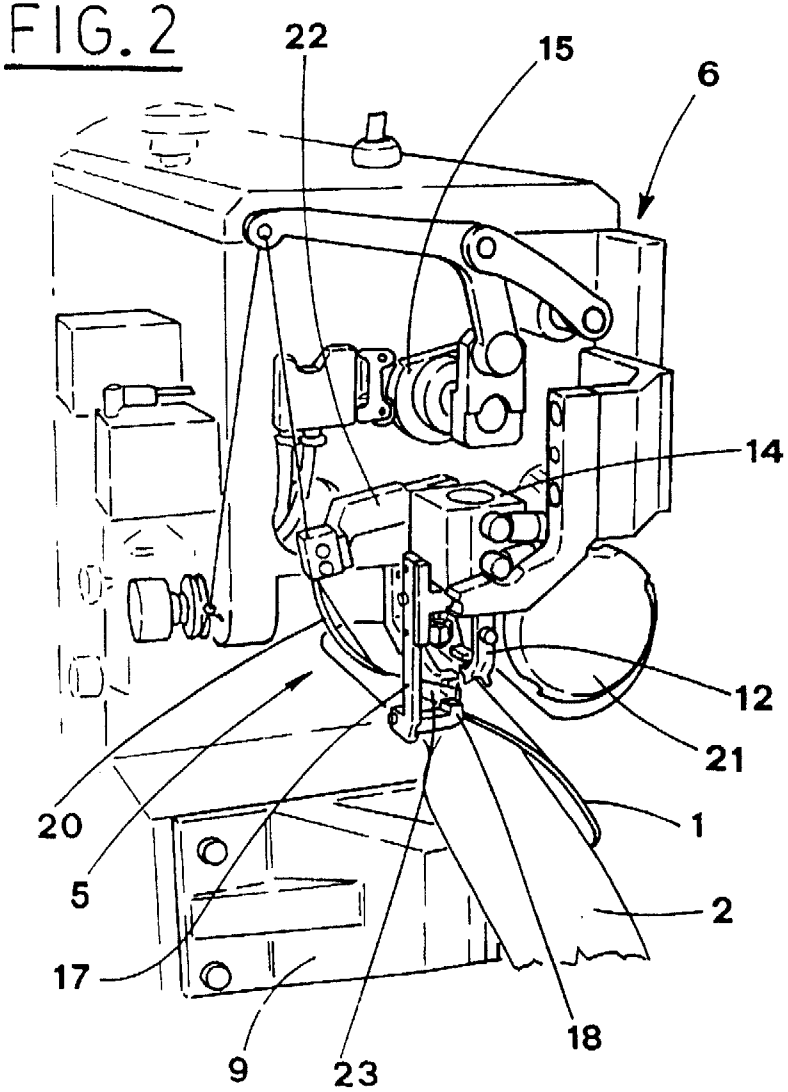
FIG. 2 is a perspective view of the stitching device, being the subject of the present invention, mounted on the sewing machine.
Figure 5:
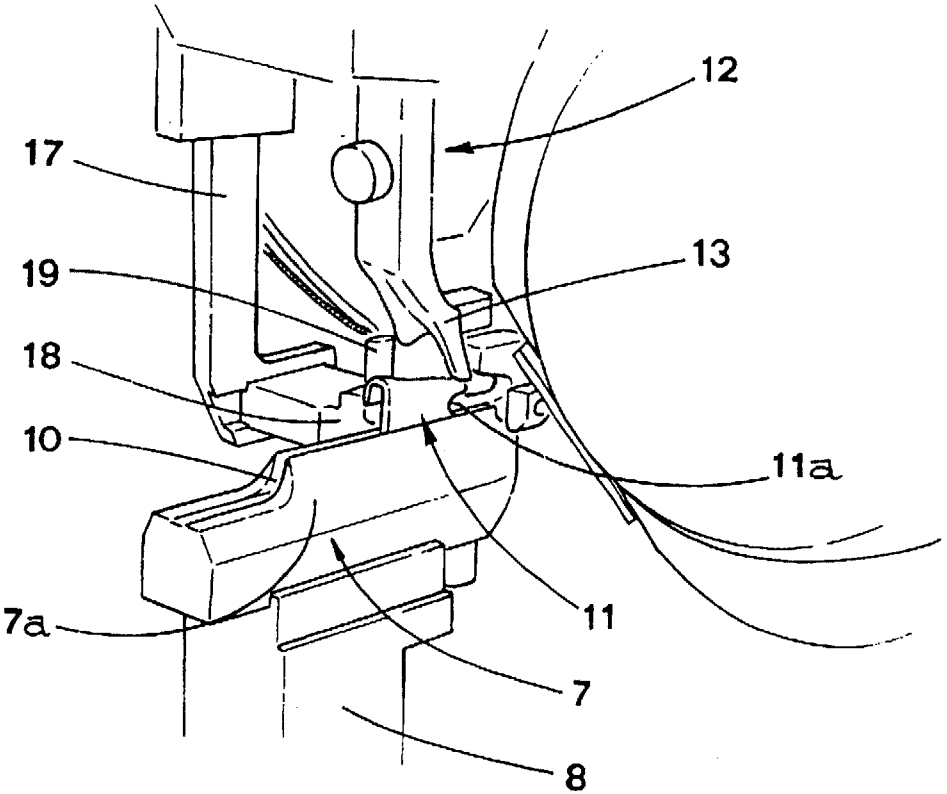
FIGS. 4 and 5 are perspective views of the stitching device, seen at different angles.
Figure 4:
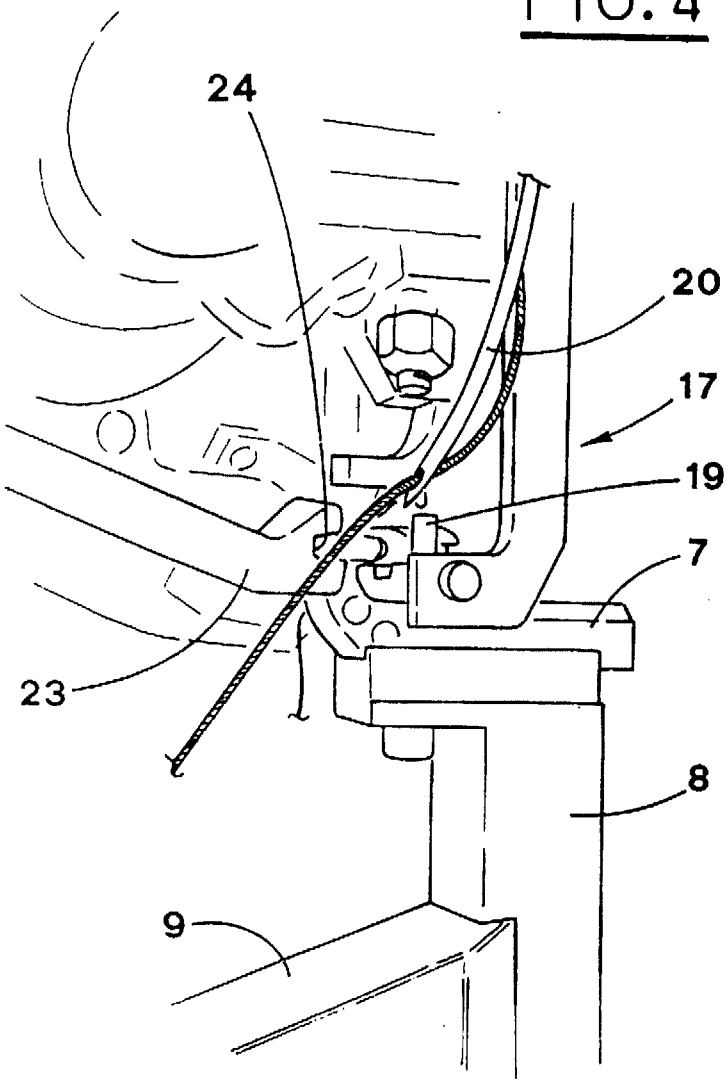

Referring to the drawings, reference numeral 5 indicates the device mounted on the sewing machine 6, in order to perform a decorative stitch on a leather article 1, constituted by a shoe upper.

The device 5 has a longitudinal guide 7, fitted to a column 8, which rises from an arm 9, integral with the fixed structure of the sewing machine; the arm 9 is a straight extension of the front surface of the machine structure.

A part of the guide 7, is laterally delimited by inclined flat surfaces *7a,7b*, upwardly convergent. The inclined surfaces *7a,7b* form respective work tops, on which leather articles 1 and 2 to be sewn are moved stepwise, by known means which are not shown.

At its top, the guide 7 features a longitudinal prismatic groove 10. A curved winglet 11 is joined to the groove 10 of the guide 7 and is folded downwards so as to overhang the surface *7b*, on which the upper 2 moves.

The edge the toe cap 1 rests on the upper part of the curved winglet 11 and its lower part guides the edge of the shoe upper 2.

A folding over member 12, moves vertically over the winglet 11, and press the edge of the toe cap 1 by means of a shaped head 13 that defines a recess, complementary to the curved winglet 11.

The folding over member 12 is reciprocated by an actuator 14, that moves along a short stroke, and is acted upon by a cam 15 serving for adjustment of the working step; the stroke of the folding over mender can be adjusted, in a known way.

A support element 17, aimed at working in conjunction with the member 12, is equipped with a shaped foot 18, designed to press the edge of the upper 2 against the above mentioned surface *7b*.

A tooth 19, destined to act as a lateral stop for the folded edge of the toe cap 1, extends from the foot 18. The position of the support element 17 can be adjusted vertically and in direction transversal to the guide 7, in relation with the width of the overlapped edge to be obtained.

The sewing machine includes a longitudinal shaft that is equipped with a transversal arm 22, to which extremity a curved needle 20, is mounted. The needle 20 oscillates between a raised position, beside the work top *7b* of the guide 7, and a lowered position, in which the needle 20 passes through the is leather articles to be sewn.

The needle 20 oscillates in a suitable phase relation with the movement of the leather article to be sewn. It is to be pointed out that the needle 20 while oscillating passes through to a slot *11a*, made in the front part of the winglet 11.

The shaft of the needle 20 is axially reciprocated, in a suitable phase relation with the movement of the leather articles to be sewn.

A crochet 21, equipped with a spool filled with a thread, works in conjunction with the needle 20. The crochet 21 is situated beside the work top *7a* of the guide 7.

The device 5 features a leather pressing element 23, that acts on the leather article 1 in position adjacent to the just formed stitch 4, and that is situated in a position behind the stitching zone, that oscillates on a plane transversal to the longitudinal guide 7, on the same side of the foot 18.

The leather pressing element 23 features a longitudinal slot 24 through which the needle 20 passes. The operation of the machine will now be illustrated beginning from a step before a stitch is made.

Figure 6:
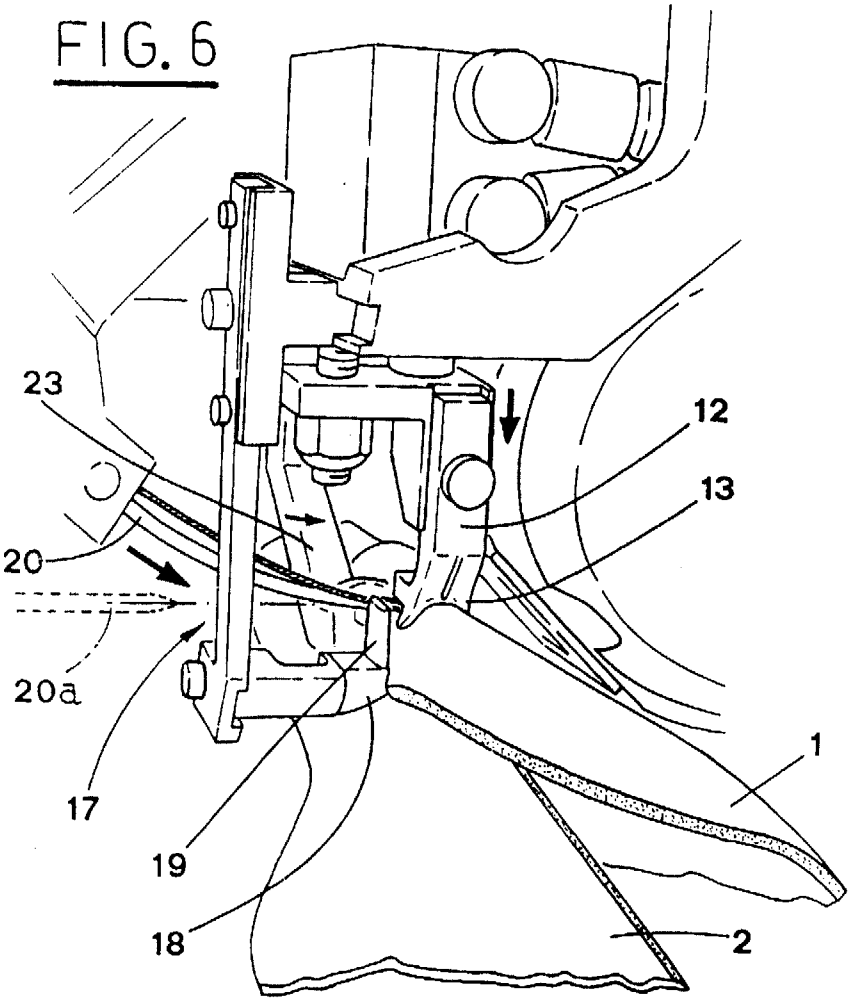

In this moment, the folding over member 12 is set in vertical motion and goes down on the longitudinal guide 7 so as to act, by the shaped head 13, on the edge 3 of the toe cap 1, fed to the work top *7a* of this guide 7 (FIG. 6).

Then, the edge 3 is folded over on the curved winglet 11, integral with the guide 7, so as to overlap the edge of the shoe upper 2, fed on the work top *7b* of the same guide 7; the edge of the upper 2 is instead inserted under the curved winglet 11.

As shown in FIG. 9, the edge 3 of the toe cap 1 is kept in the overfolded position by the tooth 19 of the support element 17, while the edge of the shoe upper 2 is kept by the foot 18.

In this configuration, the needle 20 goes down and, in cooperation with the crochet 21, makes a stitch 4 on the edges of the leather articles 1 and 2. The needle 20, following a circular trajectory, passes through the edge 3 of the toe cap 1, folded over and overlapping on the edge of the shoe upper 2 (see again FIG. 6).

After having passed through the edges of the leather articles 1 and 2, the needle 20 is moved to the working zone of the crochet 21; in a known way, the loop made by the thread of the needle 20 is hooked, due to the oscillation of the crochet 21.

Figure 7:
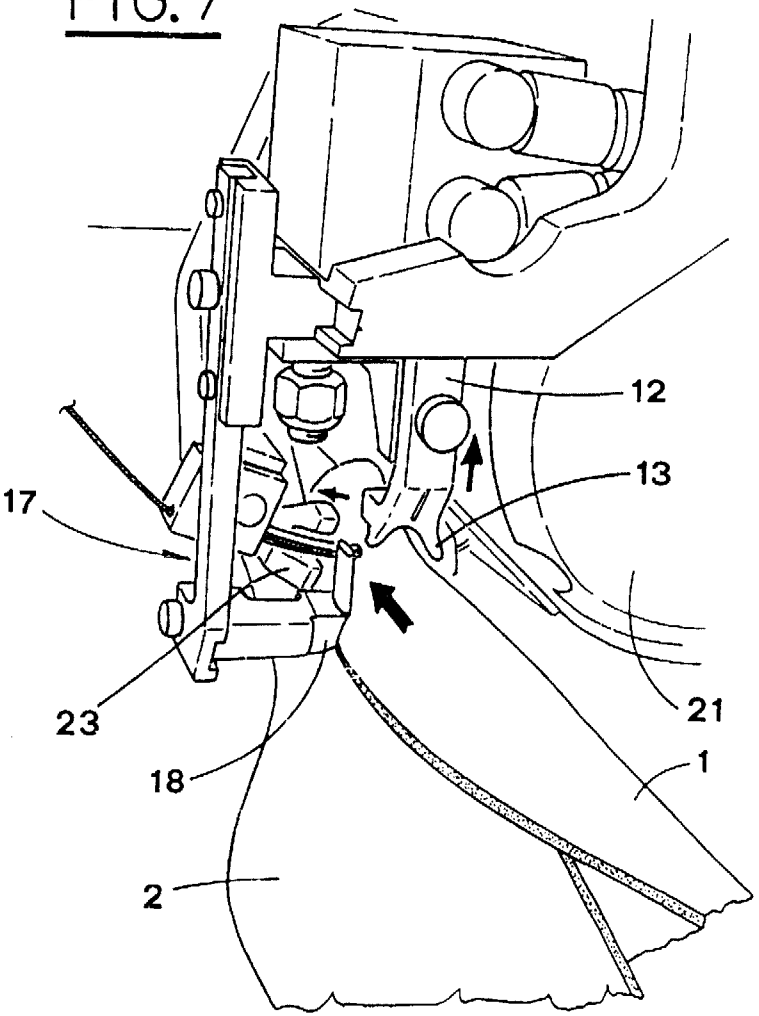
FIGS. 6, 7 and 8 are views of different working steps of the device shown in FIG. 3.

After the needle has passed through the edges of the leather articles 1 and 2, the folding over member 12 is raised, so that the leather articles 1 and 2 can move forward along the guide 7 (FIG. 7).

This movement of the shoe upper 1, operated by known and not illustrated means, is synchronous with the longitudinal translation of the needle 20 in the same direction.

It is to be pointed out that the folding over member 12 does not follow the longitudinal translation of the leather articles 1 and 2 along the guide 7, but it moves only along its vertical axis.

Figure 8:
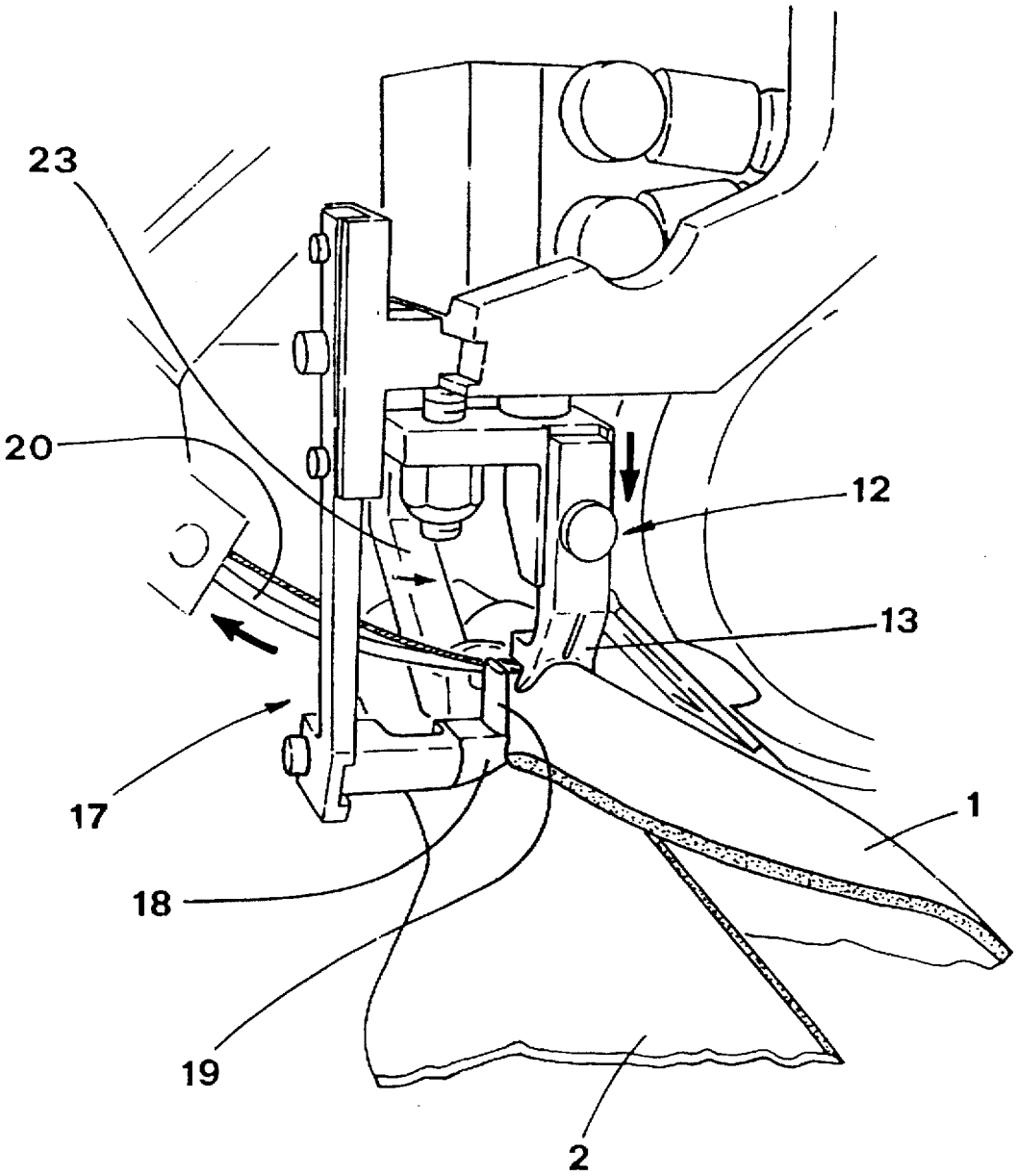

When the longitudinal translation has been completed, the leather pressing element 23 is moved again to oscillate on a plane transversal to the longitudinal guide 7, and clamps the sewn edges of the leather articles 1 and 2, in a position adjacent to the just made stitch 4 (see FIG. 8).

This allows to maintain the stitching zone of the leather articles 1 and 2, when the needle 20 rises, so that the thread hooked by the crochet 21 forms the loop.

At this point, the needle 20 together with the crochet 21 are longitudinally translated in the direction opposite to the direction of the shoe upper movement, so as the initial conditions can be restored, in order to perform the next stitch.

Consequently, the above described device allows to automatically perform stitching of leather articles with overlapped edges.

In particular, the device allows to sew, in a simplified way, the toe cap 1 to an open shoe upper 2, with overlapped edges thereof.

It is to be pointed out that the above mentioned operations are carried out in a simple way during a normal sewing cycle of the machine, without changing the working time and function of this cycle.

In particular, the device can be applied to the known sewing machines of the same type. The device can also use a straight needle instead of the curved one, that acts in horizontal direction, as shown with the broken line *20a* in FIG. 6.

I claim:

1. An improved device for sewing two articles, particularly leather articles with overlapped edges, characterized in that it includes a longitudinal guide (7), a part of which is laterally delimited by two inclined flat surfaces (*7a,7b*), upwardly convergent, on which a first article (1) and a second article (2) to be sewn together are moved;

a curved winglet (11), made integral with the top of said longitudinal guide (7) and bent downwards to overhang an inclined surface (*7b*) of the same guide (7);

a folding over member (12), moved vertically over the longitudinal guide (7) so as to clamp and release an edge (3) of said first article (1) on said curved winglet (11), overfolding the same edge (3) so as to overlap an edge of said second article (2), while a needle (20) makes a stitch (4); and a support element (17), equipped with a foot (18), provided for pressing the edge of said second article against one of said inclined surfaces (7*b*) of the guide (7) .

2. A device, according to claim 1, characterized in that a tooth (19), that acts as lateral stop for the overfolded edge (3) of said first articles (1), extends upwardly from the foot (18).

3. A device, according to claim 1, characterized in that it features a leather pressing element (23), that oscillates on a plane transversal to the longitudinal guide (7), on the same side of the longitudinal guide where the foot (18) is located, said leather pressing element (23) being provided for pressing the sewn edges of said leather articles (1,2), in position adjacent to the just formed stitch (4), when the needle (20) goes up.

4. A device, according to claim 1, characterized in that in its lower part, said folding over member (12) features a shaped head (13), that has a recess complementary to said curved winglet (11), this shaped head being provided for clamping said edge (3) of the first articles (1) to the same curved winglet (11).

5. A device, according to claim 1, characterized in that said folding over member (12) is reciprocated by an actuator (14), that moves along a short stroke, and is acted upon by a cam (15) provided for adjusting the working step.

6. A device, according to claim 1, characterized in that said longitudinal guide (7) is fitted to a column (8), which rises from an arm (9) that is a straight extension of a front surface of the sewing machine (6) .

7. A device, according to claim 1, characterized in that the said guide (7) features a prismatic longitudinal groove (10) in which said curved winglet (11) is inserted.

* * * * *